US009033768B2

(12) United States Patent
Cvjetkovic et al.

(10) Patent No.: US 9,033,768 B2
(45) Date of Patent: May 19, 2015

(54) METHOD AND DEVICE FOR MACHINING SHAFTS

(75) Inventors: Tom Cvjetkovic, Mainz (DE); Stefan Hambel, Eisenberg (DE); Erich Ostermeyer, Kirchheimbolanden (DE); Stefan Eisinger, Alzey (DE)

(73) Assignee: BorgWarner Inc., Auburn Hills, MI (US)

( * ) Notice: Subject to any disclaimer, the term of this patent is extended or adjusted under 35 U.S.C. 154(b) by 1055 days.

(21) Appl. No.: 13/125,977

(22) PCT Filed: Oct. 14, 2009

(86) PCT No.: PCT/US2009/060576

§ 371 (c)(1),
(2), (4) Date: Apr. 26, 2011

(87) PCT Pub. No.: WO2010/053665

PCT Pub. Date: May 14, 2010

(65) Prior Publication Data

US 2011/0207384 A1 Aug. 25, 2011

(30) Foreign Application Priority Data

Oct. 29, 2008 (DE) ..... 10 2008 053 631

(51) Int. Cl.
*B24B 5/22* (2006.01)
*B24B 5/307* (2006.01)

(52) U.S. Cl.
CPC .. *B24B 5/22* (2013.01); *B24B 5/307* (2013.01)

(58) Field of Classification Search
CPC ..... F16B 2/14; B24B 5/307; B24B 5/22
USPC ..... 451/385, 386, 397, 398, 399, 49; 269/43, 45, 47, 53, 309–310, 143, 196, 269/229, 231, 900
See application file for complete search history.

(56) References Cited

U.S. PATENT DOCUMENTS

| | | | | | |
|---|---|---|---|---|---|
| 1,814,362 | A * | 7/1931 | Booth | 451/244 |
| 2,194,089 | A * | 3/1940 | Johnson | 451/365 |
| 3,621,620 | A * | 11/1971 | Kinder et al. | 451/365 |
| 4,150,955 | A * | 4/1979 | Samuelson | 51/298 |
| 4,352,511 | A * | 10/1982 | Ribble et al. | 285/91 |
| 4,759,244 | A * | 7/1988 | Engibarov | 82/154 |
| 5,551,795 | A * | 9/1996 | Engibarov | 403/381 |
| 5,984,291 | A * | 11/1999 | Iwata et al. | 269/73 |
| 6,350,080 | B1 * | 2/2002 | Do et al. | 403/381 |
| 7,744,636 | B2 * | 6/2010 | Richelsoph | 606/272 |

FOREIGN PATENT DOCUMENTS

| | | | |
|---|---|---|---|
| DE | 102010026826 | A1 * | 3/2011 |
| FR | 2323908 | A1 * | 4/1977 |

* cited by examiner

*Primary Examiner* — Lee D Wilson
*Assistant Examiner* — Joel Crandall
(74) *Attorney, Agent, or Firm* — A. Michael Tucker; Stephan A. Pendorf; Patent Central LLC

(57) ABSTRACT

The invention relates to a device (1) for machining a stepped shaft (2), having a workpiece rest (6); having a disk arrangement (3) which has a grinding disk (4) and a control disk (5); and having an axial stop arrangement (7), wherein the axial stop arrangement (7) has a contact adapter (8) which can be temporarily placed in contact with an end surface portion (9) of the shaft (2) and which has a punctiform contact surface (10) for contact against a stop part (11) of the stop arrangement (7).

14 Claims, 3 Drawing Sheets

METHOD AND DEVICE FOR MACHINING SHAFTS

BACKGROUND OF THE INVENTION

1. Field of the Invention

The invention relates to a method and to a device for machining stepped shafts.

2. Description of the Related Art

Prior art for the machining of a stepped shaft is grinding using centering bores. However, this has the disadvantage that productivity is low and the production tolerances are relatively large on account of the bracing of the shaft and the associated deformations. It is likewise known to machine stepless shafts by means of so-called centerless grinding without the use of centering bores.

BRIEF SUMMARY OF THE INVENTION

It is therefore an object of the present invention to create a method and a device for machining a shaft, in particular a stepped shaft, which enable increased productivity in relation to the prior art and permit an improvement in production accuracy.

This object is achieved by means of a method for machining a stepped shaft (2), having the following method steps: placing the shaft (2) on a workpiece rest (6); placing an end surface (20) of the shaft (2) in contact with an axial stop part (11) of the workpiece receptacle (6), and grinding that region (2A, 2B, 2C) of the shaft (2) which is to be machined, wherein the end surface (20) of the shaft (2) is placed in contact with the stop part (11) by means of punctiform contact (10). The object is also achieved by means of a device (1) for machining a stepped shaft (2), having a workpiece rest (6); having a disk arrangement (3) which has a grinding disk (4) and a control disk (5); and having an axial stop arrangement (7), wherein the axial stop arrangement (7) has a contact adapter (8) which can be temporarily placed in contact with an end surface portion (9) of the shaft (2) and which has a punctiform contact surface (10) for contact against a stop part (11) of the stop arrangement (7).

The fact that, according to the invention, punctiform contact is used for the axial guidance of the shaft during the machining process yields the advantage that axial run-out of the shaft and angular errors of the stop do not result in axially oscillating shaft movements which increase the production tolerances of the axial shaft steps, and have only an extremely small effect, if any, on production accuracy.

In this connection, punctiform contact is to be understood as small a (central punctiform) contact surface as possible with respect to the stop, which makes it possible to avoid the above-stated adverse effects on production accuracy.

The subclaims relate to advantageous refinements of the invention.

What is particularly advantageous is movable guidance of the shaft by means of the punctiform contact, since this permits a further increase in production accuracy.

BRIEF DESCRIPTION OF THE SEVERAL VIEWS OF THE DRAWINGS

Further details, advantages and features of the present invention can be gathered from the following description of an exemplary embodiment on the basis of the drawing, in which.

DETAILED DESCRIPTION OF THE INVENTION

Figure 1:
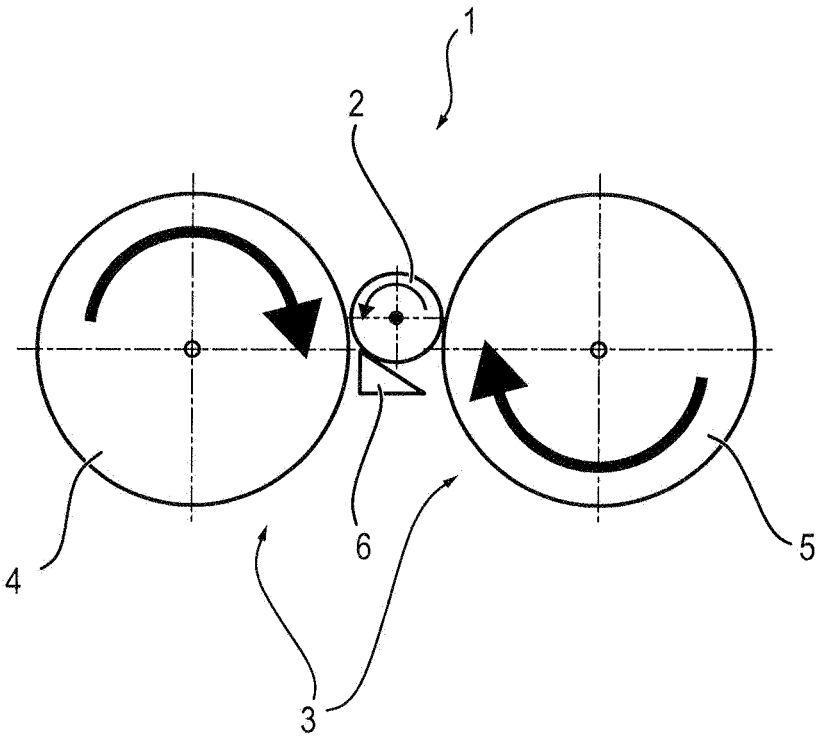
FIG. 1 shows a schematically highly simplified illustration of a device for machining a shaft.

FIG. 1 shows a device 1 for machining a shaft 2 in a schematically highly simplified illustration. The shaft 2 is a stepped shaft, as can be seen from FIG. 2, in which can be seen shaft steps 2A, 2B and 2C which each have different diameters.

FIG. 1 shows that, for machining the shaft 2, the device 1 has a disk arrangement 3 which has at least one grinding disk 4 and one control disk 5. Here, the disks 4 and 5 are arranged at both sides of the shaft 2 and both rotate in the same direction. The shaft 2 rotates in the opposite direction, and during the machining process, rests on a workpiece rest 6, which is also referred to as a grinding rule.

Figure 2:
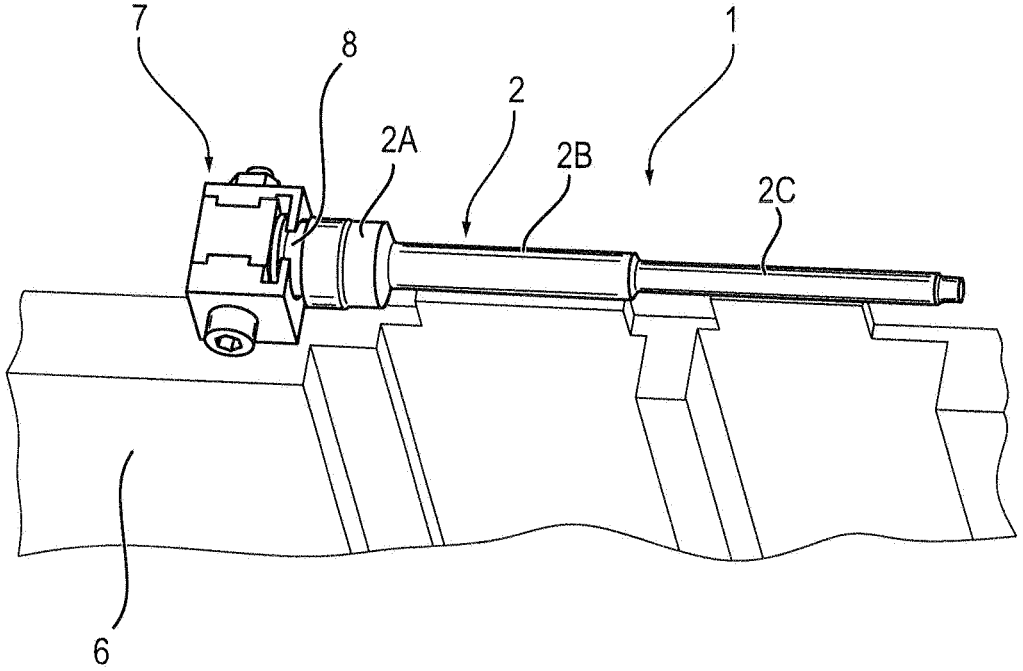
FIG. 2 shows a perspective view of a shaft placed on a workpiece rest, with a stop device according to the invention.

FIG. 2 illustrates the shaft 2 on the workpiece rest 6, with the disk arrangement 3 not being shown in order to simplify the illustration. FIG. 2 shows that the shaft 2 is fixed in its position on the workpiece rest 6 by an axial stop arrangement 7 which is fastened to the workpiece rest 6, as can also be seen for example from FIG. 5. The axial stop arrangement 7 will be explained in more detail below, in particular with reference to FIGS. 3 to 6.

Accordingly, the stop arrangement 7 has a contact adapter 8 which, in the example, can be temporarily plugged into an end surface portion 9 of the shaft 2, for which purpose the shaft 2 has a recess (not illustrated in any more detail in the figures) in the end surface portion 9. For this purpose, the contact adapter 8 has a journal 21 which can be seen in FIG. 5, after the removal of the shaft 2. It is likewise possible for the shaft 2 to be plugged into a bore of the contact adapter 8 or for the contact between the shaft 2 and the contact adapter 8 to be realized by means of frictional engagement in the end surfaces.

Figure 3:
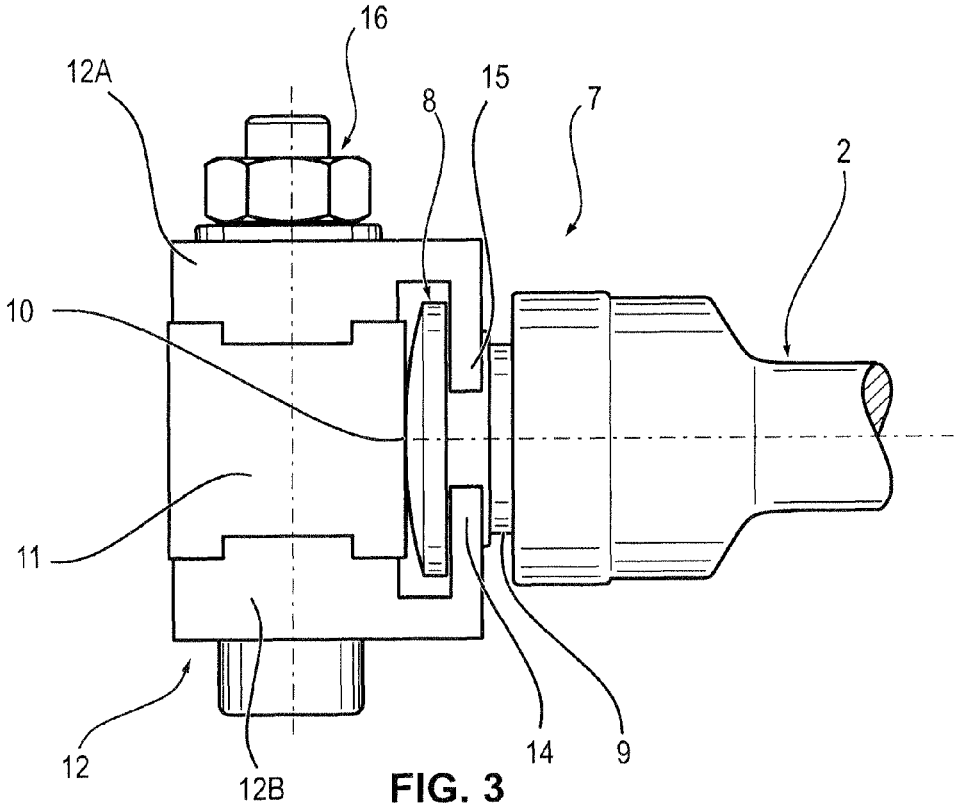
FIG. 3 shows an enlarged detail illustration of the shaft according to FIG. 2, for the explanation of a stop arrangement of the device according to the invention.
Figure 4:
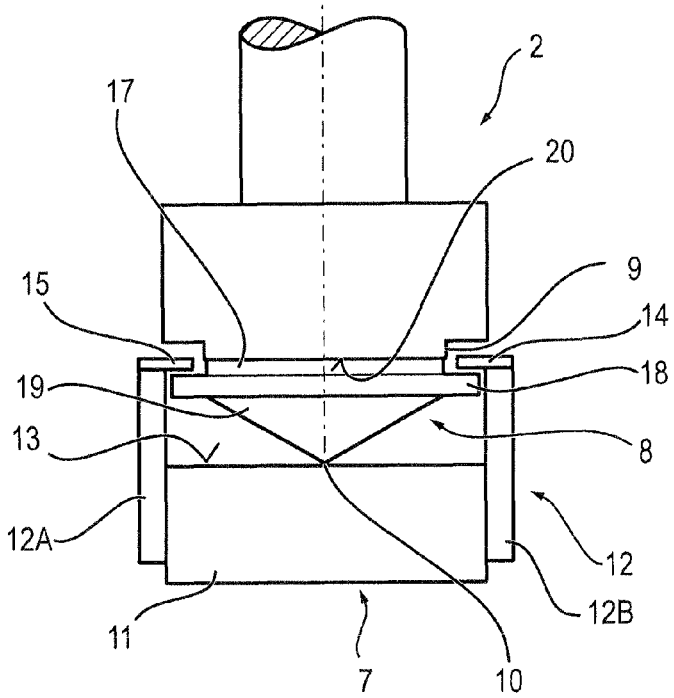
FIG. 4 shows a diagrammatic illustration of the stop arrangement according to FIG. 3.

FIGS. 3 and 4 also show that the contact adapter 8 has a punctiform contact surface 10 which is arranged between an end surface 20 of the shaft 2 and the stop part 11. As has already been explained in the introduction, the term "punctiform" is to be understood according to the invention to mean a contact surface 10 which enables an increase in the production accuracy of the shaft 2. In FIG. 4, said punctiform contact surface 10 is formed, in the schematic illustration of FIG. 4, in the manner of a point, though this is not imperative. In fact, it can be seen from FIG. 3 that a punctiform contact surface 10 may also be understood to mean an areal configuration of said contact surface 10.

FIG. 4 in particular shows that the contact adapter 8 is guided in a movable fashion in the stop arrangement 7. In the embodiment illustrated in FIGS. 3 to 6, the stop arrangement 7 has, for this purpose, for example a cage 12 in which a stop part 11 is fixed, which stop part 11 has a counterpart surface 13 on which the punctiform contact surface 10 rests during the production of the shaft 2.

Figure 5:
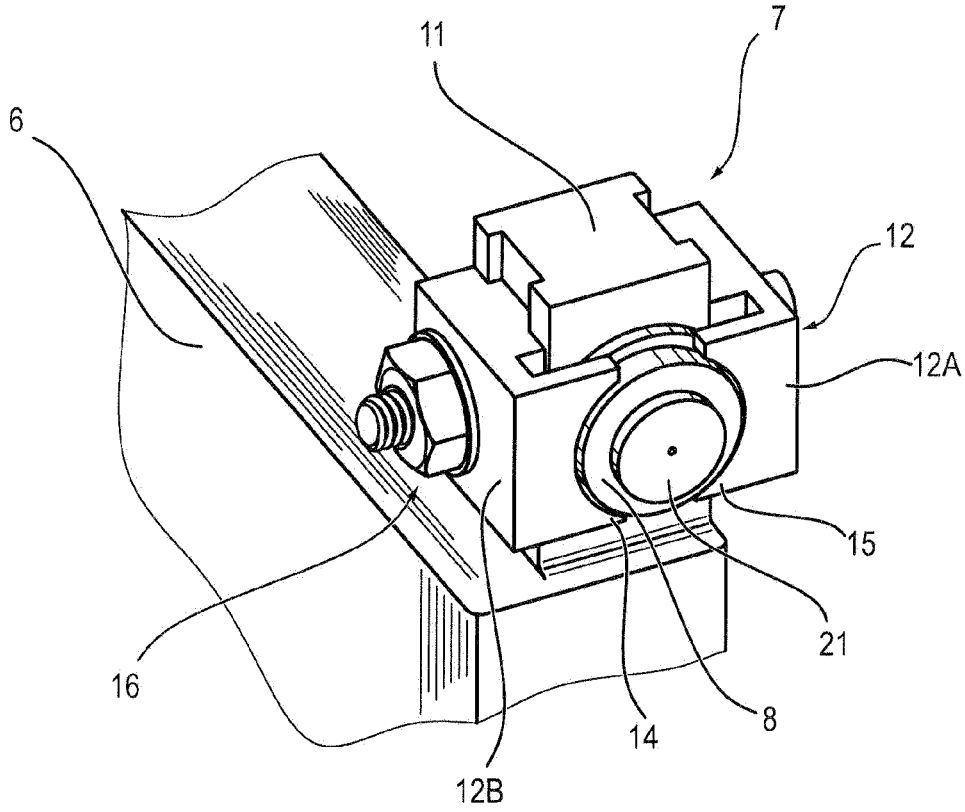
FIG. 5 shows a perspective illustration of the stop arrangement after the removal of the shaft.

In the embodiment illustrated in FIGS. 3 to 5, the stop arrangement 7 has two cage parts 12A and 12B which, in FIGS. 3 and 5, are connected to one another by means of a screw connection 16, with the stop element 11 which is arranged between the cage parts 12A and 12B functioning as a spacer.

The cage parts 12A and 12B each have retaining claws 14 and 15 which engage around a connecting region 17 of the contact adapter 8 and engage behind a retaining collar 18 so as to retain the contact adapter 8 within the cage in a movable fashion, as can be seen in particular from the schematic illustration of FIG. 4. Here, the punctiform contact surface 10 is formed on a point region 19 of the contact adapter 8.

It can be seen from the illustration of FIG. 5 that, in said embodiment, the retaining claws 14 and 15 are integral parts of the cage parts 12A and 12B and are of approximately semi-circular design, so as to provide the movable guidance of the contact adapter 8 as is desired in particular from FIG. 4 on account of the clearances shown therein between the cage 12 and the contact adapter 8. By means of said guidance, it is possible in particular for axial run-out of the end surface 20 and unevenness and angular errors of the counterpart surface 13 to be compensated in conjunction with the punctiform contact surface 10.

Figure 6:
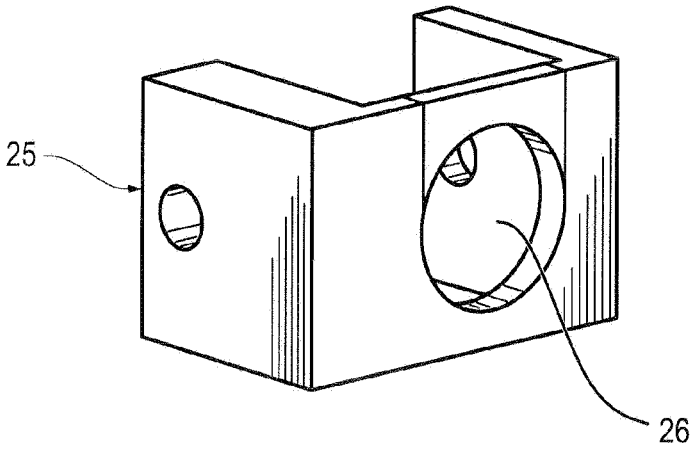
FIG. 6 shows a perspective illustration of a single-piece cage.

As illustrated in FIG. 6, the cage may also be formed in one piece. For this purpose, the retaining claws 14 and 15 are replaced by a U-shaped bracket 25 with an opening 26 for holding a contact adapter 8.

In addition to the above written disclosure, reference is hereby explicitly made to the diagrammatic illustration thereof in FIGS. 1 to 6.

LIST OF REFERENCE SYMBOLS

1 Device
2 Shaft
2A-2C Shaft steps
3 Disk arrangement
4 Grinding disk
5 Control disk
6 Workpiece rest/grinding rule
7 Stop arrangement
8 Contact adapter
9 End surface portion of the shaft
10 Contact surface/punctiform contact
11 Stop part
12 Cage
12A,B Cage parts
13 Counterpart surface for stop
14, 15 Holding claws
16 Screw connection
17 Connecting region
18 Retaining collar
19 Point region
20 End surface of the shaft
21 Journal
25 Single-part cage
26 Opening

The invention claimed is:

1. A method for machining a stepped shaft (2), having the following method steps:
placing the shaft (2) on a workpiece rest (6);
placing an end surface (20) of the shaft (2) in contact with a generally planar surface of an axial stop part (11) of the workpiece rest (6), and
grinding that region (2A, 2B, 2C) of the shaft (2) which is to be machined,
wherein
the end surface (20) of the shaft (2) is placed in contact with the stop part (11) by means of punctiform contact (10).

2. The method as claimed in claim 1, wherein the punctiform contact (10) is movable.

3. A device (1) for machining a stepped shaft (2),
having a workpiece rest (6);
having a disk arrangement (3) which has a grinding disk (4) and a control disk (5); and
having an axial stop arrangement (7),
wherein
the axial stop arrangement (7) has a contact adapter (8)
which can be temporarily placed in contact with an end surface portion (9) of the shaft (2) and
which has a punctiform contact surface (10) for contact against a generally planar surface of a stop part (11) of the stop arrangement (7).

4. The device as claimed in claim 3, wherein the stop arrangement (7) has a cage (12) in which the stop part (11) is fixed.

5. The device as claimed in claim 3, wherein the contact adapter (8) is guided in a movable fashion.

6. The device as claimed in claim 3, wherein the stop arrangement (7) is fixed to the workpiece rest (6).

7. The device as claimed in claim 3, wherein the contact adapter (8) is releasably plugged into the end surface portion (9) of the shaft.

8. A stop arrangement (7) of a device for machining a shaft,
having a contact adapter (8) which has a punctiform contact surface (10); and
having a stop part (11) which has a generally planar counterpart surface (13) for the punctiform contact surface (10).

9. The stop arrangement as claimed in claim 8, wherein the contact adapter (8) is guided in a movable fashion.

10. The stop arrangement as claimed in claim 9, further comprising a cage (12) in which the contact adapter (8) is guided in a movable fashion.

11. The stop arrangement as claimed in claim 10, wherein the stop part (11) is fixed in the cage (12).

12. The stop arrangement as claimed in claim 10, wherein the cage (12) has two cage parts (12A, 12B) which can be connected to one another by means of the stop part (11) which serves as a spacer, and said cage parts (12A, 12B) have retaining claws (14, 15) for movably guiding the contact adapter (8).

13. The stop arrangement as claimed in claim 10, wherein the cage (25) is formed in one piece and has an opening (26) through which the stop part (11) can be placed in contact with the shaft (2).

14. A stop arrangement (7) of a device for machining a shaft, having
a contact adapter (8) which has a punctiform contact surface (10);
a stop part (11) which has a counterpart surface (13) for the punctiform contact surface (10); and
a cage (12) in which the contact adapter (8) is guided in a movable fashion,
wherein the cage (12) has two cage parts (12A, 12B) which can be connected to one another by means of the stop part (11) which serves as a spacer, and said cage parts (12A, 12B) have retaining claws (14, 15) for movably guiding the contact adapter (8), and
wherein, to connect the cage parts (12A, 12B), a screw connection (16) is provided which extends through said cage parts (12A, 12B) and the stop part (11).

* * * * *